US007540749B1

(12) United States Patent
Hall et al.

(10) Patent No.: US 7,540,749 B1
(45) Date of Patent: Jun. 2, 2009

(54) CONNECTOR ASSEMBLIES AND SYSTEMS

(75) Inventors: John Wesley Hall, Harrisburg, PA (US); Douglas John Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/027,174

(22) Filed: Feb. 6, 2008

(51) Int. Cl.
*H01R 13/44* (2006.01)

(52) U.S. Cl. ..... 439/135; 439/596

(58) Field of Classification Search ..... 439/596, 439/135

See application file for complete search history.

(56) References Cited

U.S. PATENT DOCUMENTS 3,332,053 A * 7/1967 Busler ..... 439/596
3,412,225 A * 11/1968 Rogers et al. ..... 200/452
3,519,978 A * 7/1970 Taormina et al. ..... 439/596
5,256,072 A * 10/1993 Hatagishi ..... 439/79
5,295,857 A * 3/1994 Toly ..... 439/395
5,338,211 A * 8/1994 Kodama et al. ..... 439/135
5,571,030 A * 11/1996 Gladd et al. ..... 439/489
5,759,065 A * 6/1998 Hatagishi et al. ..... 439/596
D401,560 S * 11/1998 Nakamura ..... D13/156
5,967,842 A * 10/1999 Okabe ..... 439/596
6,024,605 A * 2/2000 Beck et al. ..... 439/595
6,027,374 A * 2/2000 Nagai et al. ..... 439/596
6,443,755 B1 * 9/2002 Beukes et al. ..... 439/402
6,537,099 B2 * 3/2003 Herlinger et al. ..... 439/352
6,568,967 B2 * 5/2003 Inaba et al. ..... 439/701
6,761,589 B2 * 7/2004 Venditti et al. ..... 439/596
7,249,962 B2 * 7/2007 Milette et al. ..... 439/425
2002/0064981 A1 * 5/2002 Yu et al. ..... 439/135
2003/0139094 A1 * 7/2003 Venditti et al. ..... 439/596

* cited by examiner

*Primary Examiner*—T C Patel
*Assistant Examiner*—Vladimir Imas

(57) ABSTRACT

A connector assembly includes a header having a first interface and a receptacle housing having a plurality of walls defining a component chamber and an opening providing access to the component chamber. The component chamber receives the header therein through the opening, and a hinged cover covers the opening. The hinged cover includes opposed first and second sides with the first side hingedly attached to one of the walls of the receptacle housing by at least one hinge. The hinged cover also includes a securing element on the second side for engagement with one of the walls of the receptacle housing. The hinged cover further includes a cover catch extending from the first side that engages a locking element extending from one of the walls of the receptacle housing, wherein the cover catch secures the first side of the cover to the receptacle housing and the securing element secures the second side to the receptacle housing.

20 Claims, 5 Drawing Sheets

CONNECTOR ASSEMBLIES AND SYSTEMS

BACKGROUND OF THE INVENTION

The subject matter herein relates generally to connector assemblies and systems, and more particularly, to a connector assembly having a hinged cover.

Motor vehicles and other equipment include various electronic devices mounted therein. The devices may control various systems and/or subsystems. For example, the motor vehicle may include an audio system or a global positioning system (GPS) therein. It may be desirable for the operator of the vehicle to transmit data between the various electronic devices and an external device, such as a personal computer (PC), a personal digital assistant (PDA), an audio device, such as an MP3 player, a cell phone or other external devices. Other examples of electronic devices on the motor vehicle may include a control computer that controls systems within the motor vehicle such as the fuel system, the transmission, the brakes or the steering mechanism. These control computers are typically coupled to a variety of sensors and/or actuators and the control computers may log data regarding usage of the vehicle, such as maximum speed, fuel usage, maximum acceleration, hours of usage, and the like. It may be desirable to communicate with such control computers for maintenance, diagnostics, and the like.

Accordingly, at least some motor vehicles and equipment include a communication port that provides a communication bridge between the electronic devices mounted in the vehicle and the various external devices. For example, some motor vehicles include a Universal Serial Bus (USB) interface, or other type of interface, to facilitate communication between the devices carried by the motor vehicle and the external devices. The interface allows repeated connection of the various types of external devices. However, over time, and with repeated use, the interface may wear or become damaged, which may degrade or eliminate the signal communicated across the communication bridge. For example, the interface may have a limited number of use cycles. Additionally, the interface may become contaminated by dirt, debris, a liquid spill, and the like. As such, the interface may require repair or replacement over time.

Conventional interfaces in motor vehicles and equipment include a header soldered to a circuit board of the device. When the interface needs replacement, a new circuit board and header is provided to replace the existing one. Such a repair is costly, as the header is typically the component that may need to be replaced.

Accordingly, a need remains for a connector assembly for a motor vehicle that can be manufactured and replaced in a cost effective and reliable manner.

BRIEF DESCRIPTION OF THE INVENTION

In one embodiment, a connector assembly is provided including a header having a first interface and a receptacle housing having a plurality of walls defining a component chamber and an opening providing access to the component chamber. The component chamber receives the header therein through the opening, and a hinged cover covers the opening. The hinged cover includes opposed first and second sides with the first side hingedly attached to one of the walls of the receptacle housing by at least one hinge. The hinged cover also includes a securing element on the second side for engagement with one of the walls of the receptacle housing. The hinged cover further includes a cover catch extending from the first side that engages a locking element extending from one of the walls of the receptacle housing, wherein the cover catch secures the first side of the cover to the receptacle housing and the securing element secure the second side to the receptacle housing.

Optionally, the cover catch may be engaged with the locking element when the cover is in a closed position and the cover catch may be dis-engaged from the locking element when the cover is in an open position. The cover catch may include a protrusion and the locking element may include a lid, wherein the lid resists movement of the protrusion in a direction generally away from the opening. The hinged cover may be configured to be opened by releasing the securing element and rotating the cover about the hinge. The cover may be movable between an open position and a closed position, wherein the header is removable from the component chamber when the cover is in the open position. Optionally, the cover catch may be provided to secure the first side of the cover when the hinge fails. The cover catch may represent a secondary securing feature for the cover to secure the cover to the receptacle housing if the hinge fails.

In another embodiment, a receptacle housing for a connector is provided, wherein the receptacle housing includes a plurality of walls defining a component chamber and an opening providing access to the component chamber. The component chamber is configured to receive the connector therein through the opening, and a hinged cover covers the opening. The hinged cover includes opposed first and second sides with the first side hingedly attached to a first of the walls of the receptacle housing by at least one hinge, and the hinged cover includes a securing element on the second side for engagement with a second of the walls of the receptacle housing. The hinged cover also includes a cover catch extending from the first side that engages a locking element extending from the first wall of the receptacle housing, wherein the cover catch secures the first side of the cover to the receptacle housing and the securing element secure the second side to the receptacle housing.

In a further embodiment, a connector system is provided including a bezel having a mating interface for mating with a mating connector and a connector assembly mounted to the bezel. The connector assembly is configured to connect with the mating connector, and the connector assembly includes a header having a first interface and a receptacle housing. The receptacle housing includes a plurality of walls defining a component chamber and an opening providing access to the component chamber, wherein the component chamber receives the header therein through the opening. The receptacle housing has at least one latching feature for latching engagement with the bezel. A hinged cover covers the opening and the hinged cover includes opposed first and second sides with the first side hingedly attached to one of the walls of the receptacle housing by at least one hinge. The hinged cover includes a securing element on the second side for latching engagement with one of the walls of the receptacle housing, and the hinged cover includes a cover catch extending from the first side that engages a locking element extending from one of the walls of the receptacle housing. The cover catch secures the first side of the cover to the receptacle housing and the securing element secure the second side to the receptacle housing.

DETAILED DESCRIPTION OF THE INVENTION

Figure 1:
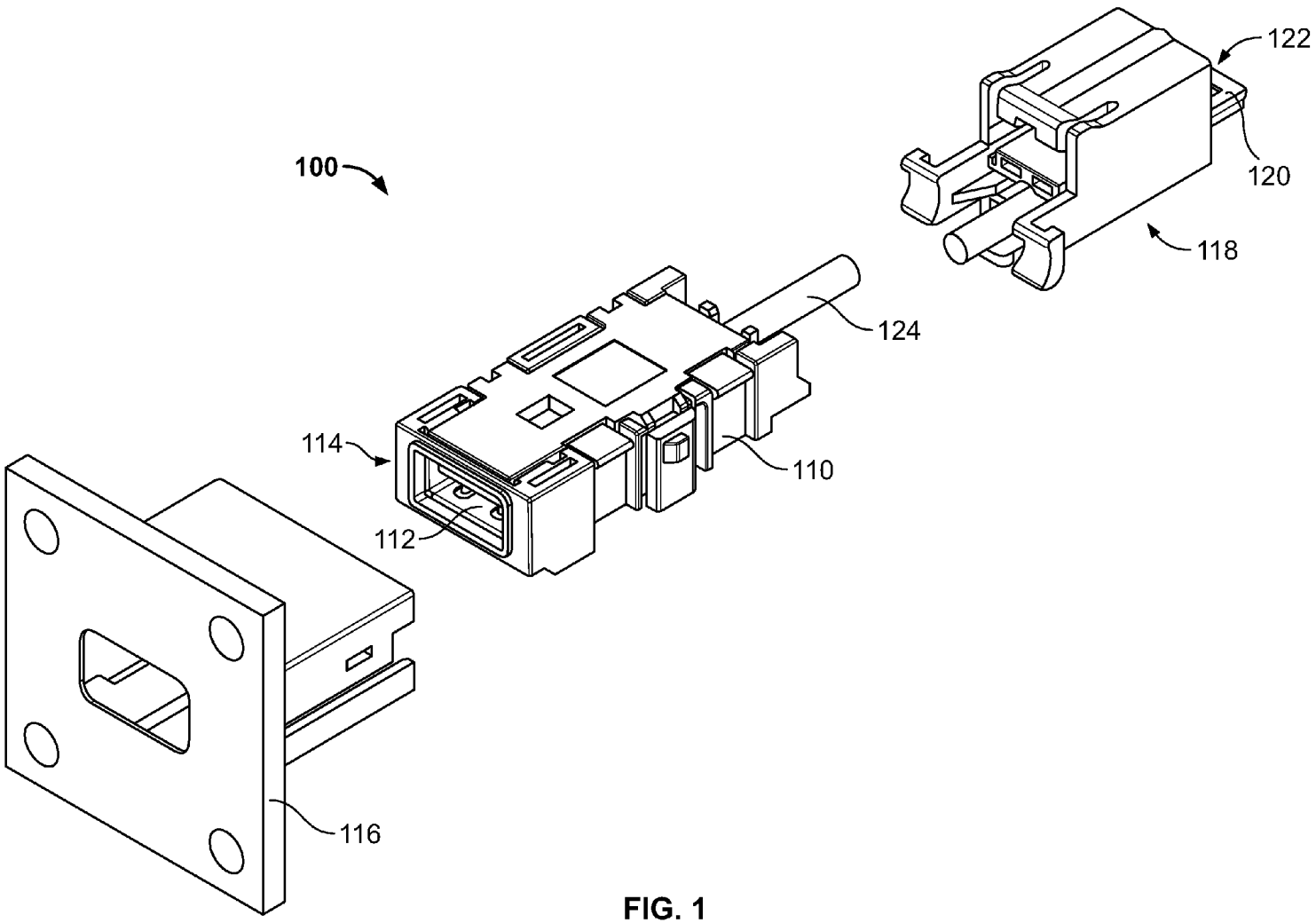
FIG. 1 is an exploded view of a connector system including a connector assembly formed in accordance with an exemplary embodiment.

FIG. 1 is an exploded view of a connector system 100 including a connector assembly 110 formed in accordance with an exemplary embodiment. While the illustrated embodiment shows a USB connector, one skilled in the art would know the disclosed features may be used on other connector types. Moreover, while the system 100 described herein is described as being adapted for USB type of connections, it is realized that other types of electrical interconnection systems may be used within the spirit and scope of the subject matter herein, and the system 100 should not be limited to USB headers and USB connectors.

The connector assembly 110 includes a first header 112 that defines a first interface 114. The system 100 also includes a bezel 116 and a cable assembly 118 having a second header 120 defining a second interface 122. In an exemplary embodiment, the first interface 114 defines a user interface and the second interface 122 defines a device interface. The first and second headers 112, 120 define interfaces that may be of the same or different types. For example, the headers may be one of a USB type A, a USB type B, a mini-USB type A, a mini-USB type B, a micro-USB type A, a micro-USB type B, or another USB type. In the illustrated embodiment, the first header 112 defines a USB Standard A receptacle interface, and the second header 120 defines a mini-USB type B receptacle interface.

The connector assembly 110 may be coupled with the bezel 116, which is mounted within a motor vehicle or piece of equipment (not shown). When coupled, the first header 112 is configured to mate with a mating connector (not shown), such as a mating connector of an external device. The external device may be a device such as an MP3 player, a PC, a PDA, a diagnostic device, and the like. The second header 120 of the cable assembly 118 is connected to the connector assembly 110 by a cable 124 and is configured to mate with another mating connector (not shown). For example, the mating connector may be on an electronic device mounted within the vehicle or piece of equipment, such as an audio system, a GPS system, a control computer, and the like.

While the system 100 is shown and described as including the bezel 116, which is mounted within a motor vehicle or piece of equipment, it is realized that the bezel 116 and/or the connector assembly 110 may be mounted within any appropriate type of electronic device. The mounting described herein is intended as illustrative and is not intended to be limited to a motor vehicle or piece of equipment, be it industrial or motive. For example, the bezel 116 may be mounted in any type of electronic device. Additionally, the connector assembly 110 may be mounted without the use of the bezel 116 in some alternative embodiments.

Figure 2:
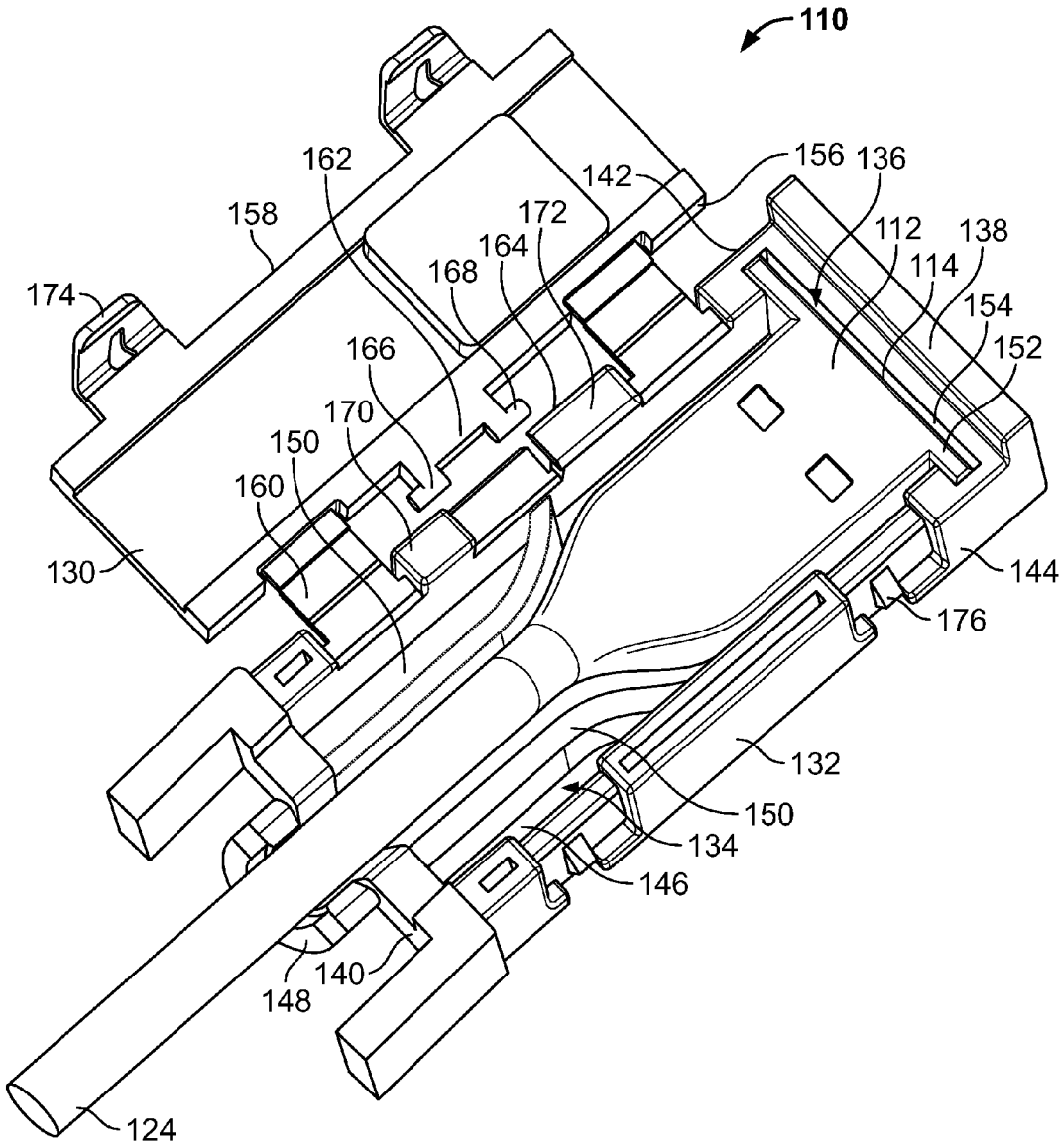
FIG. 2 illustrates the connector assembly shown in FIG. 1 with a cover of the connector assembly in an open position.

FIG. 2 illustrates the connector assembly 110 with a cover 130 of the connector assembly 110 in an open position. The connector assembly 110 includes a receptacle housing 132 having a plurality of walls defining a component chamber 134. The header 112 is received in the component chamber 134. An opening 136 provides access to the component chamber 134. In an exemplary embodiment, the header 112 is loaded into the component chamber 134 through the opening 136. The cover 130 covers, or closes access to, the opening 136 and/or the component chamber 134. In an exemplary embodiment, the receptacle housing 132 is generally box-shaped having a mating end wall 138, a terminating end wall 140, opposed first and second side walls 142, 144, and a bottom wall 146. The top includes the opening 136. While the receptacle housing 132 is illustrated as being box-shaped, the receptacle housing 132 may have any shape that is configured to receive the header 112.

The header 112 is loaded into the component chamber 134 such that the first interface 114 is provided proximate the mating end wall 138. The cable 124 of the cable assembly 118 (shown in FIG. 1) is connected to the header 112, such as at an end of the header 112 opposite to the mating interface 114. The cable 124 may be terminated to the header 112 in any known manner. The cable 124 extends from the receptacle housing 132 through the terminating end wall 140 proximate to where the cable 124 is terminated to the header 112. A portion of the terminating end wall 140 may define a cable support 148 for supporting the cable 124. In an exemplary embodiment, the receptacle housing 132 includes interior locating walls 150 that locate the header 112 within the component chamber 134. The walls 150 have a predetermined form factor that is sized and shaped to receive the header therein. Optionally, the locating walls 150 may also hold the header 112 and/or the cable 124 in place within the component chamber 134. The walls may securely retain the header 112, such as by a friction fit, or by being sized substantially, but slightly larger than, the header 112 to resist most movement of the header 112 or to allow only slight movement of the header 112. In alternative embodiments, the walls may not securely retain the header 112 within the component chamber 134. Rather, the header 112 may be otherwise retained therein, such as by ribs extending from the walls defining the component chamber 134. In an exemplary embodiment, the header 112 includes tabs 152 at a front end (e.g. at the mating interface end) thereof that are received in corresponding slots 154. The slots 154 hold the tabs 152 and resist movement of the header 112 within the component chamber 134. For example, the slots 154 and tabs 152 and/or the locating walls 150 may resist movement of the header 112 in the direction of the terminating end wall 140, such as when the cable 124 is pulled away from the receptacle housing 132.

The cover 130 is provided for closing access to the component chamber 134. The cover 130 is movable between an open position, such as the position shown in FIG. 2, and a closed position, in which the opening 136 is closed. In the illustrated embodiment, the cover 130 is generally rectangular shaped and includes opposed first and second sides 156, 158. Alternatively, the shape of the cover 130 may be non-rectangular, depending on the shape of the opening 136. In an exemplary embodiment, the first side 156 of the cover 130 is hingedly connected to the first side wall 142 by hinges 160. Optionally, the cover 130, receptacle housing 132 and hinges 160 may be integrally formed, such as by a molding process.

The first side 156 of the cover 130 includes a cover catch 162 extending therefrom. The first side wall 142 includes a locking element 164. When the cover 130 is closed, the cover catch 162 engages the locking element 164 to secure the first side 156 against the receptacle housing 132. In an exemplary embodiment, the cover catch 162 includes a first protrusion 166 in the form of a pin and a second protrusion 168 also in the form of a pin. The locking element 164 includes first and second lids 170, 172 formed in, or extending from, the first side wall 142. The protrusions 166, 168 are captured below the lids 170, 172 when the cover 130 is closed.

The second side 158 of the cover 130 includes one or more securing elements 174 that are configured to engage one or more corresponding securing elements 176 on the second side wall 144 of the receptacle housing 132. The securing elements 174 on the cover 130 may include, and are referred to hereinafter as, latches 174. The securing elements 176 on the receptacle housing 132 may include, and are referred to hereinafter as, latching tabs 176. The latches 174 extend generally perpendicular to the cover 130 and extend along the second side wall 144 when the cover is in the closed position. The latching tabs 176 extend outward from the second side walls 144 and are sized and shaped to fit into apertures in the latches 174. Alternative securing elements 174, 176 may be provided in alternative embodiments to securely retain the second side 158 of the cover against the receptacle housing 132.

Figure 3:
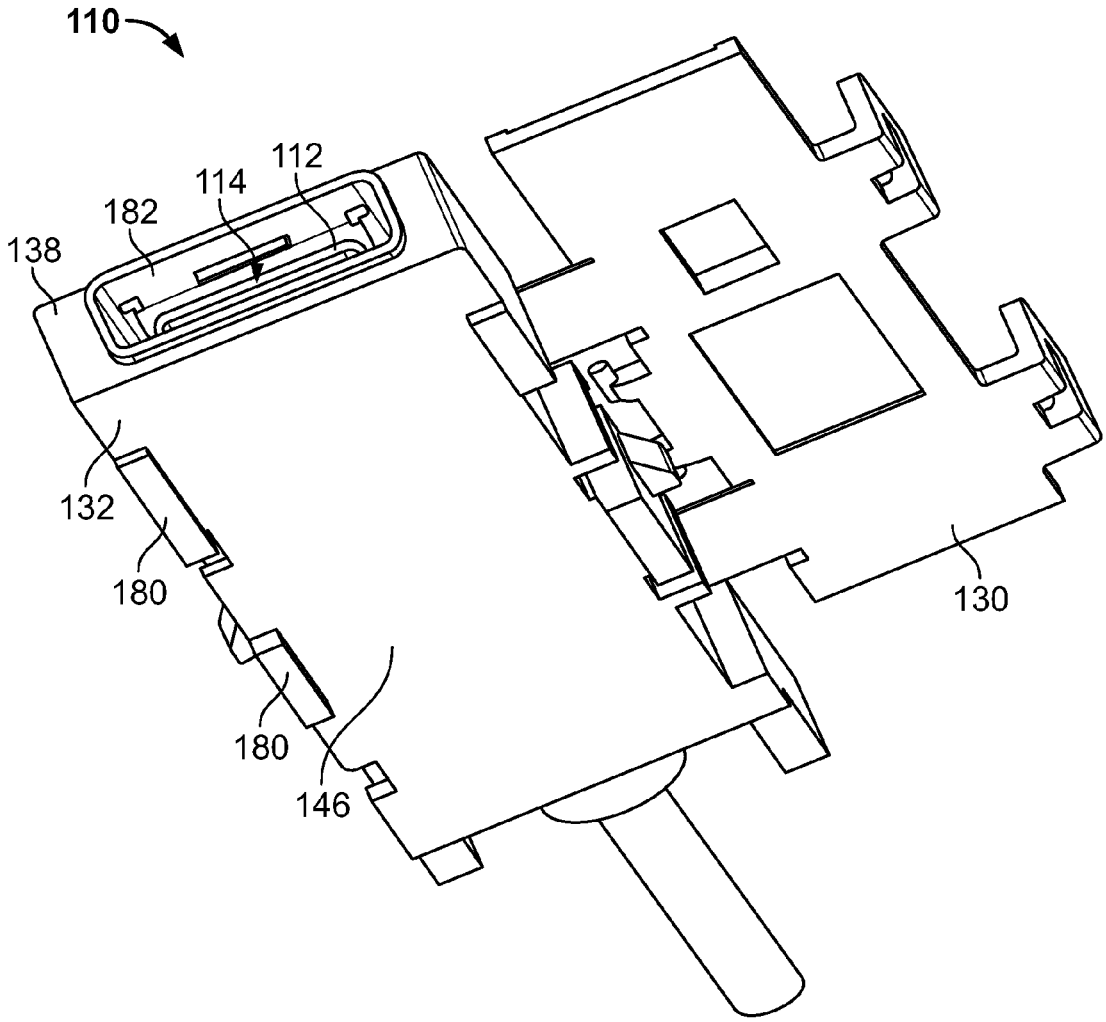
FIG. 3 is a bottom perspective view of the connector assembly shown in FIG. 2.

FIG. 3 is a bottom perspective view of the connector assembly 110, illustrating the cover 130 in the open position. The receptacle housing 132 includes keying features 180 along the bottom wall 146. The keying features 180 may be positioned along the sides, as illustrated in FIG. 3, or may be positioned elsewhere, such as along a central portion of the bottom wall 146.

The receptacle housing 132 includes an opening 182 through the mating end wall 138 that provides access to the first mating interface 114. In an exemplary embodiment, the first header 112 is a USB type A receptacle that receives a USB plug therein, however other types of interfaces may be provided in alternative embodiments. The opening 182 is sized and shaped to receive the plug of the mating connector (not shown).

Figure 4:
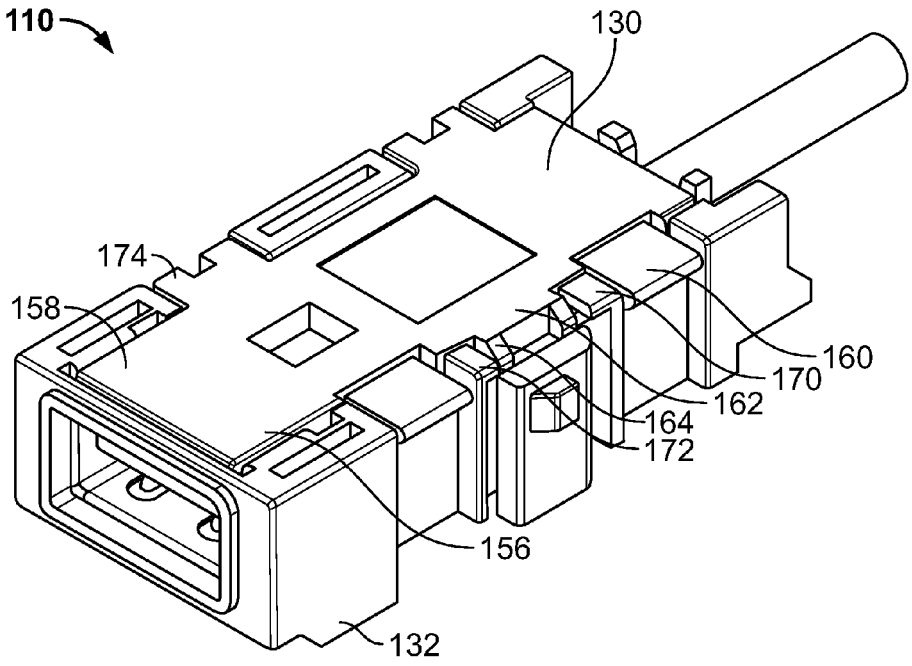
FIG. 4 is a top perspective view of the connector assembly with the cover in a closed position.

FIG. 4 is a top perspective view of the connector assembly 110 with the cover 130 in a closed position. The cover 130 is rotated to the closed position about the hinges 160. The latches 174 are securely engaged with the latching tabs 176 (shown in FIG. 2). The latches 174 keep the second side 158 of the cover 130 closed against the receptacle housing 132. To open the cover 130 again, the latches 174 are released from the latching tabs 176 and the cover 130 is rotated about the hinges 160 to the open position.

The hinges 160 keep the first side 156 of the cover 130 closed against the receptacle housing 132. Although the hinges 160 are intended for multiple uses, it is possible that the hinges 160 may break due to use and/or due to the environment in which the connector assembly 110 is operated. For example, in a motor vehicle, the connector assembly 110 may be subjected to vibrations and other sudden movements that may cause the hinges to break.

The cover catch 162 is employed to additionally secure the first side 156 of the cover 130 closed against the receptacle housing 132. For example, in the closed position, the protrusions 166, 168 (shown in FIG. 2) of the cover catch 162 are captured beneath the lids 170, 172. The lids 170, 172 may resist movement of the cover 130 in a direction generally away from the receptacle housing 132 (e.g. in an opening direction). The cover catch 162 and the locking element 164 supplement the hinges 160 in keeping the cover 130 closed, and thus operate as a secondary securing element. Alternatively, when closed, the cover catch 162 may operate as a primary securing element by substantially eliminating stress on the hinge 160, thus leading to extended hinge life.

Figure 5:
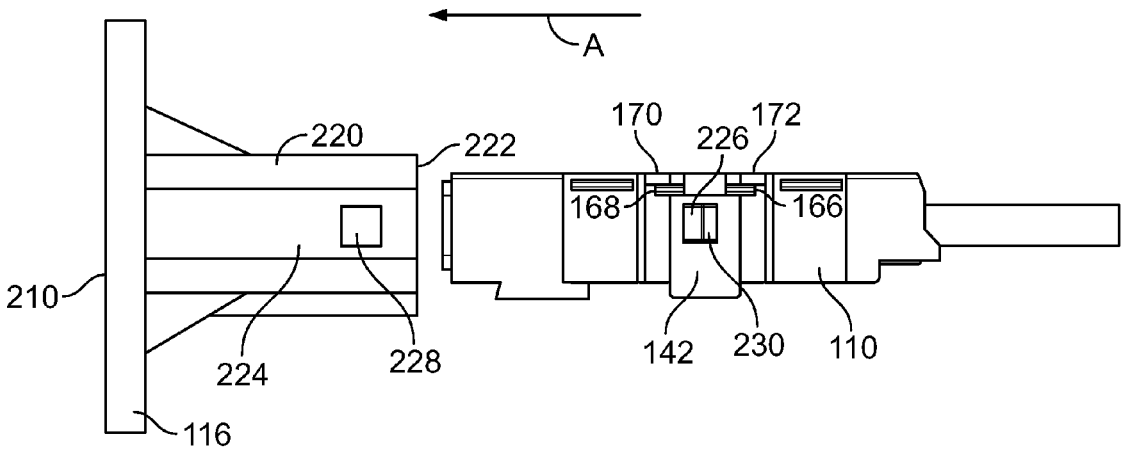
FIG. 5 is a side view of the connector assembly being assembled with a bezel of the connector system shown in FIG. 1.

FIG. 5 is a side view of the connector assembly 110 being assembled with the bezel 116 of the connector system 100 (shown in FIG. 1). The bezel 116 includes a mating interface 210 for mating with the mating connector (not shown). The bezel 116 may be securely mounted within a structure or frame of, for example, a motor vehicle. A shroud 220 extends away from the mating interface 210. The connector assembly 110 is coupled to the shroud 220, such as by plugging into a rear end 222 of the shroud 220 in a loading direction, shown by arrow A in FIG. 5.

The bezel 116 includes latching features 224 and the connector assembly 110 includes latching features 226. The connector assembly 110 is plugged into the shroud 220 until the latching features 224 of the shroud 220 engage the latching features 226 of the connector assembly 110. In an exemplary embodiment, the latching features 224 of the shroud 220 define deflectable latches 224 and the latching features 226 of the receptacle housing 110 define ramps 226 that extend outward from the side walls 142, 144 (144 is shown in FIG. 2). The deflectable latches 224 include openings 228 therein that are sized and shaped to receive the ramps 226. During mating, the deflectable latches 224 are deflected outward as the connector assembly 110 is loaded into the shroud 220. When mated, the deflectable latches 224 are deflected to securely retain the connector assembly 110 within the shroud 220. For example, the ramps 226 may be received within the openings 228 and a rear end 230 of the ramps 226 may engage the opening 228 to resist removal of the connector assembly 110 from the shroud 220. Alternative latching features known in the art may be used to securely retain the connector assembly 100 within the shroud 220.

Figure 6:
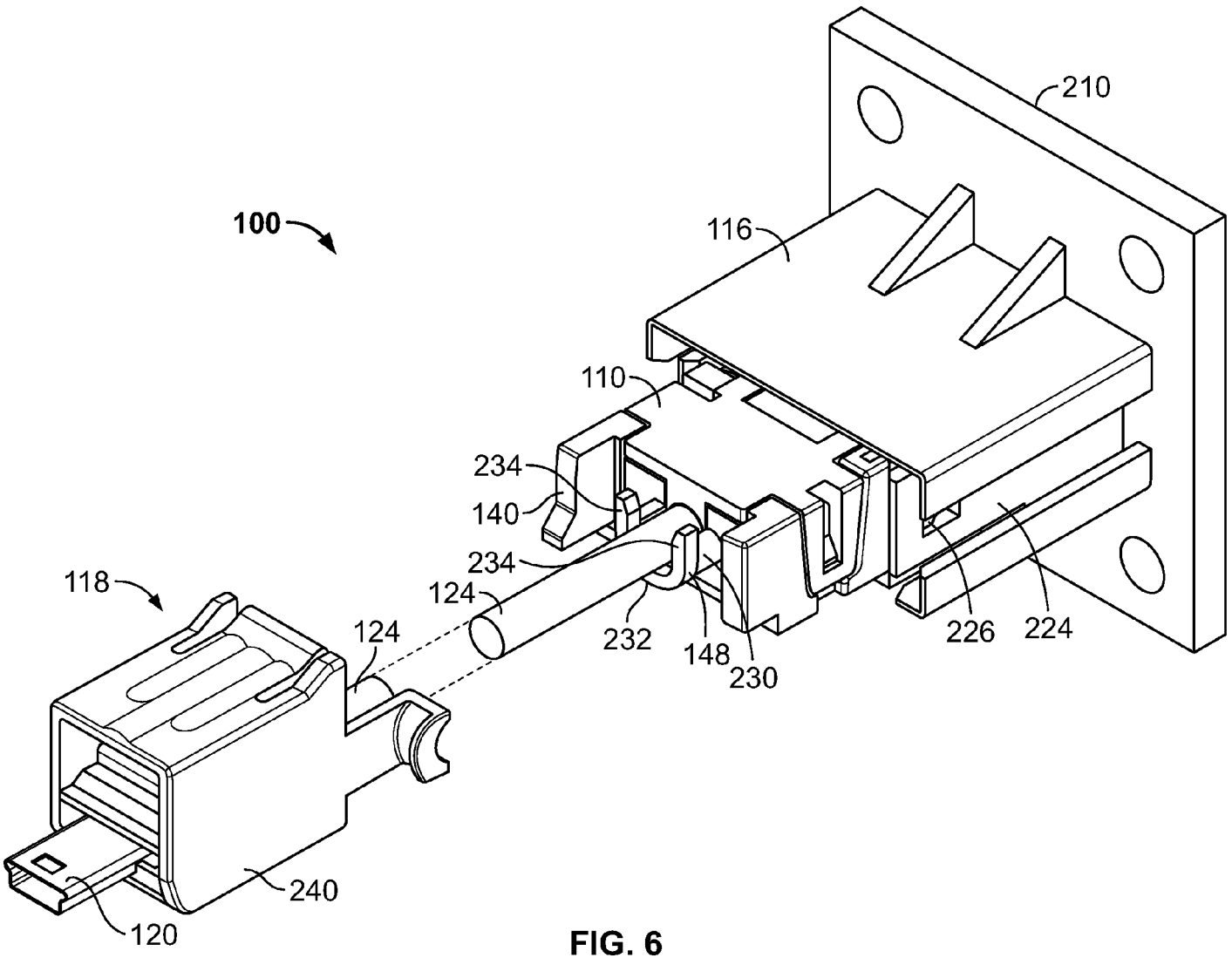
FIG. 6 illustrates the connector system in an assembled state.

FIG. 6 illustrates the connector system 100 in an assembled state. The connector assembly 110 is coupled to the bezel 116 by securing the latching features 224 to the latching features 226. When assembled, the first interface 114 (shown in FIG. 1) is substantially aligned with the mating interface 210 of the bezel 116.

The cable assembly 118 extends from the connector assembly 110. More particularly, the cable 124 extends from the terminating end wall 140. The cable support 148 supports the cable 124. In an exemplary embodiment, the cable support 148 defines a strain relief on the cable 124. The cable support 148 may include a cradle 230 having a cradle wall 232 and projections 234. The cradle 230 may be sized, shaped and/or positioned to receive a strain relief element between the cradle 230 and the terminating end wall 140. For example, a zip tie element (not shown) may be provided that extends around the cradle wall 232 and the cable 124 and that is captured between the projections and the terminating end wall 140. When cinched down, the zip tie element may securely retain the cable 124 within the cradle 230. The zip tie element may provide strain relief for the cable 124.

The second header 120 is provided at the opposed end of the cable 124. A housing 240 may surround the second header 120. The second header 120 is adapted for mating connection with a mating connector. In the illustrated embodiment, the second header 120 represents a USB mini-B plug connector, however other types of interfaces may be provided in alternative embodiments. The cable 124 may have any length.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly comprising:

a header having a first interface;

a receptacle housing having opposed first and second walls defining a component chamber and an opening providing access to the component chamber, the component chamber receives the header therein through the opening; and a hinged cover covering the opening, the hinged cover includes opposed first and second sides with the first side hingedly attached to the first wall of the receptacle housing by at least one hinge, the hinged cover includes a securing element on the second side for engagement with the second wall of the receptacle housing, and the hinged cover includes a cover catch extending from the first side that engages a locking element extending from the first wall of the receptacle housing, wherein the cover catch secures the first side of the cover to the receptacle housing and the securing element secures the second side to the receptacle housing.

2. The assembly of claim 1, wherein the cover catch is engaged with the locking element when the cover is in a closed position and the cover catch is dis-engaged from the locking element when the cover is in an open position.

3. The assembly of claim 1, wherein the cover catch includes a protrusion and the locking element includes a lid, the lid resists movement of the protrusion in a direction generally away from the opening.

4. The assembly of claim 1, wherein the hinged cover is configured to be opened by releasing the securing element and rotating the cover about the hinge.

5. The assembly of claim 1, wherein the cover is movable between an open position and a closed position, and wherein the header is removable from the component chamber when the cover is in the open position.

6. The assembly of claim 1, wherein the cover catch is provided to secure the first side of the cover when the hinge fails.

7. A receptacle housing for a connector, the receptacle housing comprising:

a plurality of walls including side walls extending between a top edge and a bottom edge and a bottom wall at the bottom edge of the side walls, the side walls and the bottom wall define a component chamber, the plurality of walls being integrally formed with one another;

an opening opposite the bottom wall, the opening providing access to the component chamber, the component chamber configured to receive the connector therein through the opening; and a hinged cover for covering the opening, the hinged cover includes opposed first and second sides with the first side hingedly attached to a first of the side walls of the receptacle housing by at least one hinge, the hinged cover includes a securing element on the second side for engagement with a second of the side walls of the receptacle housing, and the hinged cover includes a cover catch extending from the first side that engages a locking element extending from the first side wall of the receptacle housing, wherein the cover catch secures the first side of the cover to the receptacle housing and the securing element secures the second side to the receptacle housing.

8. The receptacle housing of claim 7, wherein the cover catch includes a protrusion and the locking element includes a lid, the lid resists movement of the protrusion in a direction generally away from the opening.

9. The receptacle housing of claim 7, wherein the walls have a predetermined form factor configured to securely retain the connector within the component chamber, the walls defining at least one slot configured to receive a tab extending from the connector.

10. A connector system comprising:

a bezel having a mating interface for mating with a mating connector; and a connector assembly mounted to the bezel and configured to connect with the mating connector, the connector assembly comprising:

a header having a first interface;

a receptacle housing having a opposed first and second walls defining a component chamber and an opening providing access to the component chamber, the component chamber receives the header therein through the opening, the receptacle housing having at least one latching feature for latching engagement with the bezel; and a hinged cover covering the opening, the hinged cover includes opposed first and second sides with the first side hingedly attached to the first wall of the receptacle housing by at least one hinge, the hinged cover includes a securing element on the second side for engagement with the second wall of the receptacle housing, and the hinged cover includes a cover catch extending from the first side that engages a locking element extending from the first wall of the receptacle housing, wherein the cover catch secures the first side of the cover to the receptacle housing and the securing element secure the second side to the receptacle housing.

11. The system of claim 10, wherein the bezel includes a shroud, the receptacle housing being pluggable into the shroud, at least one of the shroud and the receptacle housing having a keying feature for proper orientation of the receptacle housing with respect to the shroud.

12. The system of claim 10, wherein the bezel includes a shroud, the receptacle housing being pluggable into the shroud, the shroud includes a latching feature that cooperates with the latching feature of the receptacle housing to securely couple the receptacle housing to the bezel.

13. The system of claim 10, further comprising a cable assembly connected to the header, the cable assembly having a cable extending from the header and a second header at an opposite end of the cable.

14. The assembly of claim 1, wherein the locking element is provided at an exterior edge of the receptacle housing.

15. The assembly of claim 1, wherein the first wall is integrally formed with the second wall.

16. The assembly of claim 1, wherein the cover is integrally formed with the first wall.

17. The assembly of claim 1, wherein the opening is sized to receive the header therein to position the header in proper orientation relative to each of the walls.

18. The assembly of claim 1, wherein the opening is provided in a top of the receptacle housing, the hinged cover covers the entire top of the receptacle housing.

19. The receptacle housing of claim 7, wherein the side walls define an outer perimeter of the receptacle housing.

20. The receptacle housing of claim 7, wherein the locking element extends from an edge defined at the top of the first side wall.

* * * * *